US005713759A

United States Patent [19]

Shinozaki

[11] Patent Number: 5,713,759

[45] Date of Patent: Feb. 3, 1998

[54] INSULATED JOINT TERMINAL

[75] Inventor: Tetsuya Shinozaki, Yokkaichi-City, Japan

[73] Assignee: Sumitomo Wiring Systems, Ltd., Japan

[21] Appl. No.: 691,115

[22] Filed: Aug. 1, 1996

[30] Foreign Application Priority Data

Aug. 1, 1995 [JP] Japan ..... 7-216617

[51] Int. Cl.[6] ..... H01R 31/08

[52] U.S. Cl. ..... 439/511

[58] Field of Search ..... 439/511, 595, 439/752, 189

[56] References Cited

U.S. PATENT DOCUMENTS 3,728,656 4/1973 Neuber ..... 439/511
5,437,565 8/1995 Atsumi et al. .

FOREIGN PATENT DOCUMENTS 2-21107 8/1986 Japan .
2-102684 8/1990 Japan .
5-45939 6/1993 Japan .

*Primary Examiner*—Neils Abrams
*Assistant Examiner*—Christopher Goins
*Attorney, Agent, or Firm*—Jordan B. Bierman; Bierman, Muserlian and Lucas

[57] ABSTRACT

A joint terminal which connects a plurality of electrically conductive spaced apart contacts. The contacts are electrically connected to each other by a connector at their proximal ends by means of a connector attached thereto. The portion of the joint terminal which protrudes from the housing is surrounded by an insulative resin layer. This provides both protection and gripping surfaces for insertion and removal of the joint terminal from the connector housing. Additionally, ridges are provided on the projecting portion which can be gripped by the fingers if needed.

14 Claims, 5 Drawing Sheets

INSULATED JOINT TERMINAL

This Application claims the priority of Japanese Application 7-216617, filed Aug. 1, 1995.

The present Invention is directed to a joint terminal wherein a plurality of contacts, which are electrically connected at a point remote from their mating ends, are joined with the same number of other contacts. As a result, the various wires are electrically connected with one another.

BACKGROUND OF THE INVENTION

Prior joint terminals of the foregoing type comprised a plurality of contacts, were adapted to connect with another electrical element at the front thereof, and were connected to each other adjacent the rear thereof. These devices contained a plurality of cavities which were formed by separating walls which extended from the front to the rear surface of the connector housing. Therefore, in order to connect the contacts to one another, the ends of the contacts had to protrude from the rear surface of the connector housing. The connector extending between the contacts and the protruding portion of the contacts themselves could not be insulated and, therefore, the joint terminal had an uninsulated protruding portion. This was, of course, most undesirable.

SUMMARY OF THE INVENTION

In order to overcome the foregoing disadvantage, it is among the objects of the present Invention to provide a joint terminal of the foregoing type wherein the protruding portion is fully insulated.

The present Invention consists of a joint terminal including a plurality of electrically conductive spaced apart contacts. The distal ends of the contacts mate with other electrical elements and the proximal (rear) ends are electrically joined by a conductive connector. There is provided an insulating layer surrounding the connector and part of the contacts.

It is preferred that the proximal ends of the contacts be located in a single plane and that upper and lower ridges be provided perpendicular thereto. The front faces of the ridges will bear against and seal the cavities at the rear surface of the connector housing when the contacts are fully inserted. It is particularly desirable that the height of the ridges exceeds that of the connector housing so that they project beyond the upper and lower surfaces thereof. In this form of the Invention, the outer edges of the ridges form convenient finger grips for inserting and removing the contacts from the housing.

It has been found advantageous to provide a locking element on at least one of the contacts which protrudes in a direction normal to the plane thereof. A complementary lance is in a cavity corresponding to the contact on which the locking element is located. The lance engages the locking element when the contacts are fully inserted into the cavities and the connector housing.

As a further feature of the present Invention, there is a stabilizer on at least one of the laterally outer sides of the contacts, preferably on the contacts which are spaced apart from the contact containing the locking element. In the most desirable form of the Invention, there are three contacts, and the locking element is on the center contact. In this construction, it is advantageous to have two stabilizers., one on each of the laterally outer sides of the other two contacts.

By locating the locking element at the lateral center of the contacts, the frictional resistance to movement is balanced so that the contacts are aided in sliding in or out of the connector housing smoothly. In other words, there is no tendency for the contacts to be skewed due to uneven forces acting thereon.

In a further modification of the Invention, a retainer is provided which fits into a complementary portion of the connector housing, thereby locking the contacts in their fully inserted position.

BRIEF DESCRIPTION OF THE DRAWINGS

In the accompanying drawings, constituting a part hereof and in which like reference characters indicate like parts.

DETAILED DESCRIPTION OF THE INVENTION

Figure 1:
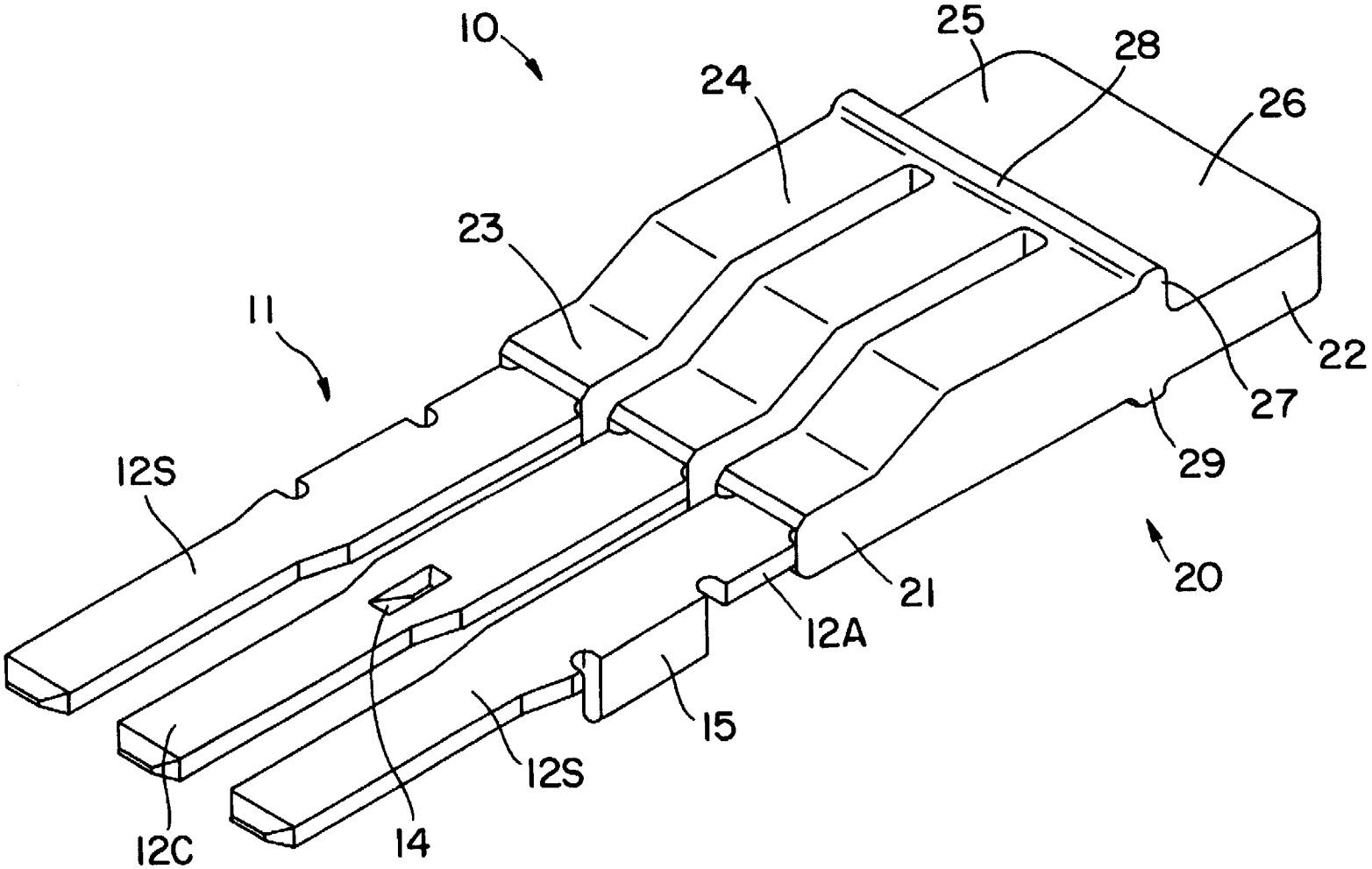
FIG. 1 is a perspective view of the joint terminal of the present Invention.
Figure 2:
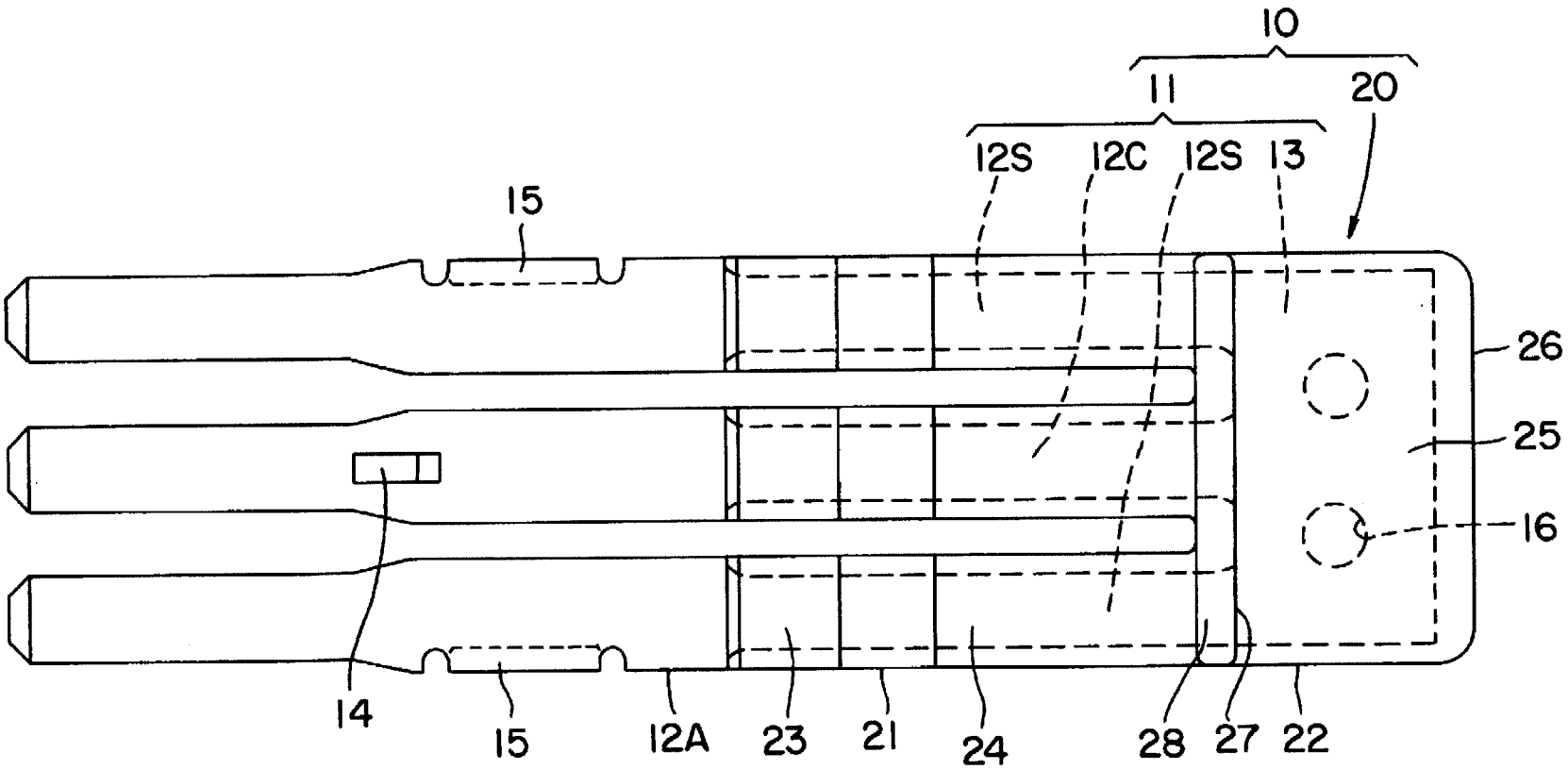
FIG. 2 is a plan view of the terminal of FIG. 1.
Figure 3:
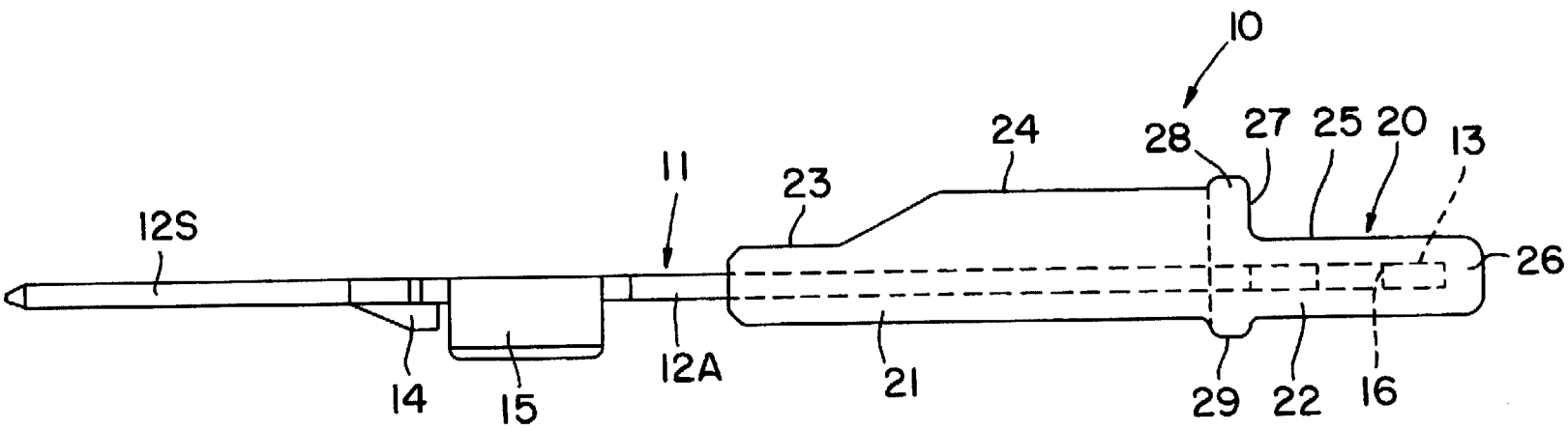
FIG. 3 is a side elevation of the joint terminal of FIG. 1.

As can be seen particularly in FIGS. 1, 2, and 3, joint terminal 10 includes main body 11, side contacts 12S and central contact 12C, intermediate portion 24, and projecting portion 25. On central contact 12C, locking element 14 is located. In addition, stabilizers 15 depend from outer sides 12A of side contacts 12S. Intermediate portion 24 is provided with side 21 and projecting portion 25 has side 22. Projecting portion 25 has gripping surfaces 26 and 27 and is also provided with ridges 28 and 29. As can be seen more particularly in FIG. 2, connector 13 electrically joins contacts 12C and 12S and retention holes 16 assist in keeping molded layer 20 firmly attached to projecting portion 25.

Figure 4:
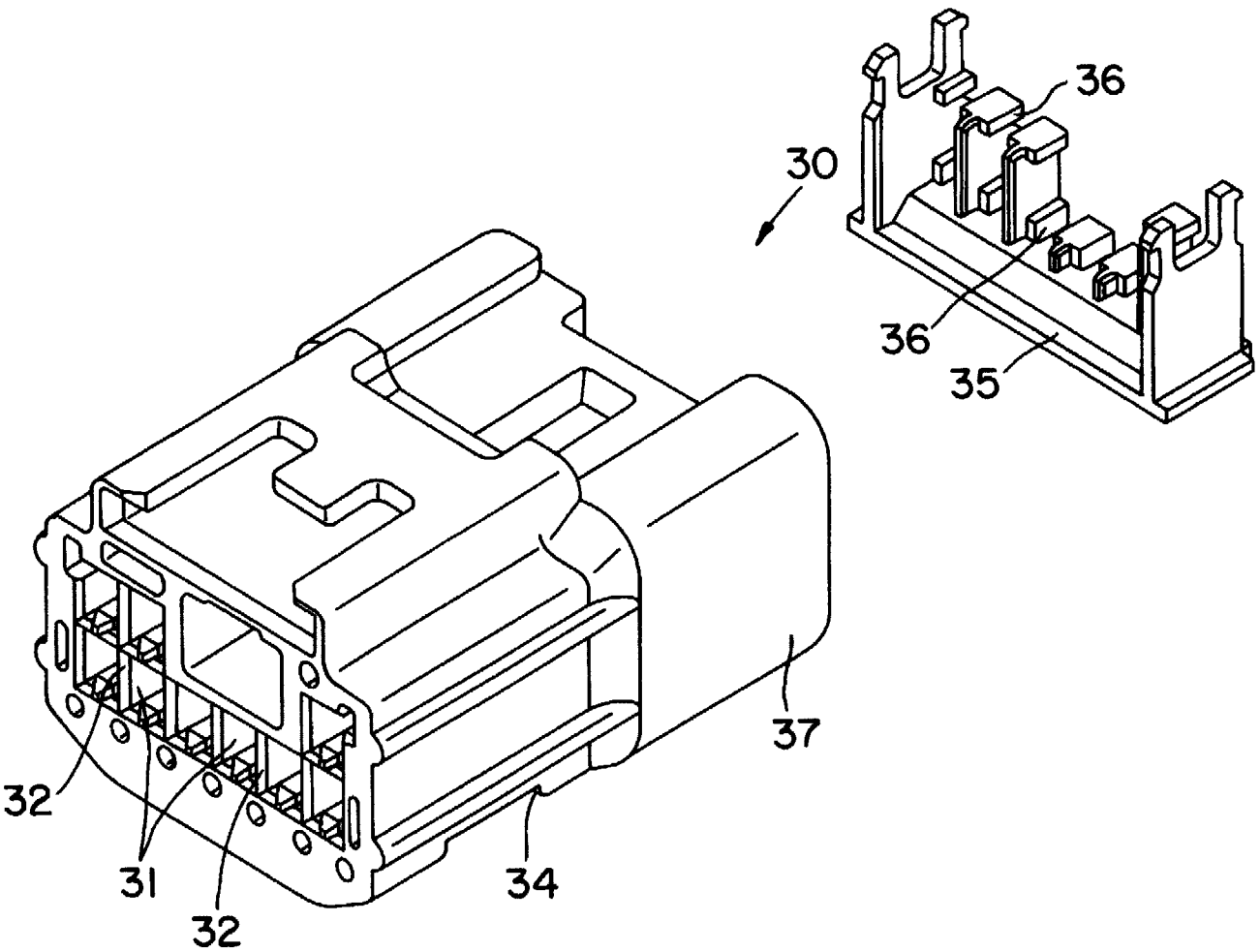
FIG. 4 is an exploded perspective view of the connector housing and the retainer of the present Invention.
Figure 5:
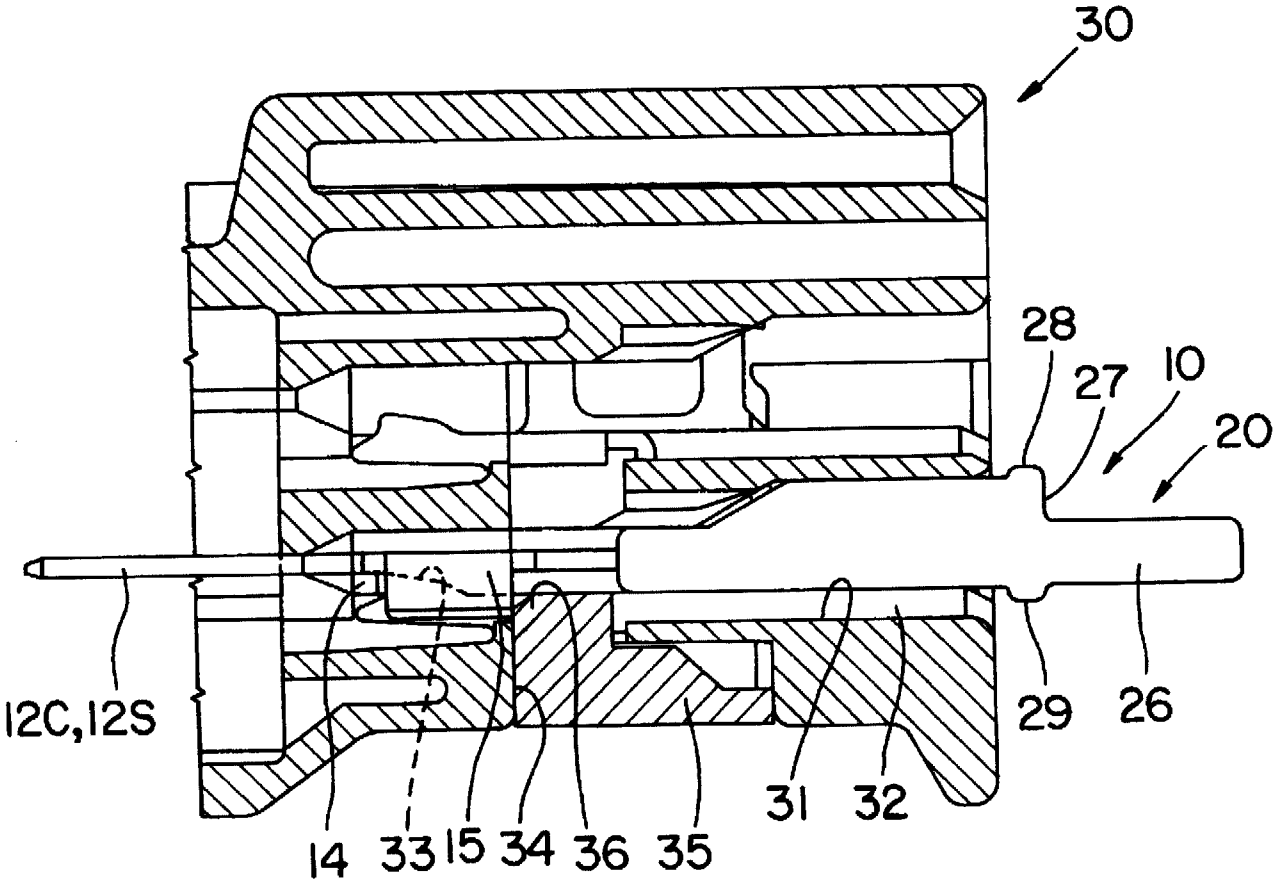
FIG. 5 is a side section of the device of FIG. 4 showing the joint terminal and retainer fully inserted in the connector housing.

In a preferred form of the Invention, as shown in FIGS. 4 and 5, lance 33 and locking element 14 cooperate to prevent unintentional withdrawal of joint terminal 10 from housing 30. Cavities 31 are formed by a series of separating walls 32 and hood 37 is provided to at least partially protect contacts 12C and 12S from unintended distortion.

In a particularly advantageous form of the device, the upper surface of mold layer 20 varies considerably in thickness. It is very thin at front edge 23, comparatively thick at intermediate portion 24, and thin at projecting portion 25. The underside is substantially the same thickness throughout.

Retainer 35, having engaging elements 36, is adapted to be inserted into recess 34 which is open to the under side. Retainer 35 has a temporary position and a permanent position, the latter being shown in FIG. 5. When in its temporary position, retainer 35 permits contacts 12S and 12C to be inserted into cavities 31. Thereafter, it is moved to its permanent position so that locking devices 36 bear against stabilizers 15, thereby locking joint terminal 10 in its fully inserted position and preventing removal thereof.

To assemble the device of the present Invention, retainer 35 is placed in its temporary position and contacts 12S and 12C are inserted into cavity 31 from the rear of connector housing 30. This is easily accomplished by gripping projecting portion 25. When contacts 12S and 12C have been fully inserted, lance 33 engages locking element 14, thereby retaining terminal 10 within housing 30. Thereafter, retainer 35 is moved to its permanent position, thereby additionally locking terminal 10 within housing 30.

If joint terminal 10 is to be removed from housing 30, retainer 35 is first moved to its temporary position. A tool (not shown) is inserted from the front end of cavity 31 and presses lance 33 down, thereby permitting joint terminal 10 to be pulled out of housing 30. This can be easily accomplished by gripping projection portion 25. If a stronger purchase is required, the upper and lower edges of ridges 28 and 29 can be used to provide a firmer grip.

Although only a limited number of specific embodiments of the present Invention have been expressly disclosed, it is, nonetheless, to be broadly construed and not to be limited except by the character of the claims appended hereto.

What we claim is:

1. A joint terminal comprising a plurality of electrically conductive spaced apart contacts, said contacts having distal ends, adapted to mate with other contacts, and proximal ends, remote from said distal ends, an electrically conductive connector adjacent said proximal ends and in contact therewith, an insulative layer surrounding said connector, said proximal ends being between a first surface and a second surface of said insulative layer, said proximal ends being in a plane, a first ridge upstanding from said first surface, perpendicular to said contacts, and having a first face which faces said contacts, a second ridge upstanding from said second surface, perpendicular to said contacts, and having a second face which faces said contacts, a housing having a plurality of cavities, each of said cavities adapted to receive one of said contacts, said first face and said second face in contact with said cavities when said contacts are in said cavities, thereby sealing said cavities.

2. The joint terminal of claim 1 wherein said insulative layer surrounds part of said contacts.

3. The joint terminal of claim 1, adapted for insertion into a housing which has a plurality of cavities therein, each of said cavities adapted to receive one of said contacts, said conductive connector with said insulative layer having a thickness substantially equal to that of said cavities.

4. The joint terminal of claim 1 wherein there are three said contacts.

5. The joint terminal of claim 1 wherein said first ridge extends beyond an upper surface of said housing in a direction perpendicular thereto and said second ridge extends beyond a lower surface of said housing in said direction.

6. A joint terminal comprising a plurality of electrically conductive spaced apart contacts, said contacts having distal ends, adapted to mate with other contacts, and proximal ends, remote from said distal ends, an electrically conductive connector adjacent said proximal ends and in contact therewith, an insulative layer surrounding said connector, said proximal ends being between a first surface and a second surface of said insulative layer, said distal ends being in a plane, one of said contacts having a locking element normal to said plane, a housing having a plurality of cavities, each of said cavities adapted to receive one of said contacts, a lance in a corresponding cavity to said one of said contacts and adapted to engage said locking element when said contacts are in said cavities.

7. The joint terminal of claim 6 wherein there is an odd number of said contacts and said locking element is on a central contact.

8. The joint terminal of claim 6 comprising at least one stabilizer on said contacts and adapted to locate said joint terminal in said housing, whereby mis-insertion of said contacts into said cavities is prevented.

9. The joint terminal of claim 8 wherein there are two stabilizers, one on each of two said contacts.

10. The joint terminal of claim 9 wherein each of said two stabilizers is on an outer contact laterally remote from said locking element.

11. The joint terminal of claim 10 wherein each of said two stabilizers is on an edge of said outer contact remote from said locking element.

12. The joint terminal of claim 6 wherein said housing has a portion adapted to receive a retainer, said retainer having at least one latching element adapted to engage said housing when said retainer is on said housing, thereby to prevent removal of said contacts from said housing.

13. A joint terminal comprising a plurality of electrically conductive spaced apart contacts, said contacts having distal ends, adapted to mate with other contacts, and proximal ends, remote from said distal ends, an electrically conductive connector adjacent said proximal ends and in contact therewith, an insulative layer surrounding said connector, said proximal ends being between a first surface and a second surface of said insulative layer, a housing having a plurality of cavities, each of said cavities adapted to receive one of said contacts, said housing having a portion adapted to receive a retainer, said retainer being provided with at least one latching element adapted to engage said housing when said retainer is on said housing, thereby to prevent removal of said contacts from said housing.

14. The joint terminal of claim 13 comprising a locking element adapted to lock said joint terminal in said housing.

* * * * *